United States Patent [19]

Agrawal et al.

[11] Patent Number: 4,947,649

[45] Date of Patent: Aug. 14, 1990

[54] CRYOGENIC PROCESS FOR PRODUCING LOW-PURITY OXYGEN

[75] Inventors: Rakesh Agrawal, Allentown; Steven R. Auvil, Macungie, both of Pa.

[73] Assignee: Air Products and Chemicals, Inc., Allentown, Pa.

[21] Appl. No.: 337,518

[22] Filed: Apr. 13, 1989

[51] Int. Cl.[5] ..... F25J 3/04

[52] U.S. Cl. ..... 62/11; 62/24; 62/44

[58] Field of Search ..... 62/9, 11, 13, 23, 24, 62/32, 36, 42, 44

[56] References Cited

U.S. PATENT DOCUMENTS

| | | | |
|---|---|---|---|
| 4,224,045 | 9/1980 | Olszewski et al. | 62/30 |
| 4,303,428 | 12/1981 | Vandenbussche | 62/30 |
| 4,382,366 | 5/1983 | Gaumer | 62/31 |
| 4,464,188 | 8/1984 | Agrawal et al. | 62/13 |
| 4,655,809 | 4/1987 | Shenoy | 62/18 |
| 4,707,994 | 11/1987 | Shenoy et al. | 62/11 |

*Primary Examiner*—Ronald C. Capossela

*Attorney, Agent, or Firm*—Russel L. Brewer; James C. Simmons; William F. Marsh

[57] ABSTRACT

This invention relates to an improved cryogenic separation process employing a single pressure distillation column for the recovery of low purity, high pressure oxygen. The process uses two working fluids, i.e., high pressure air and high pressure nitrogen to effect reboil in the column. Both the condensed air and nitrogen streams are fed as reflux streams to the distillation column. The use of nitrogen reflux enhances oxygen recovery by enhancing purity of the nitrogen from the column.

12 Claims, 1 Drawing Sheet

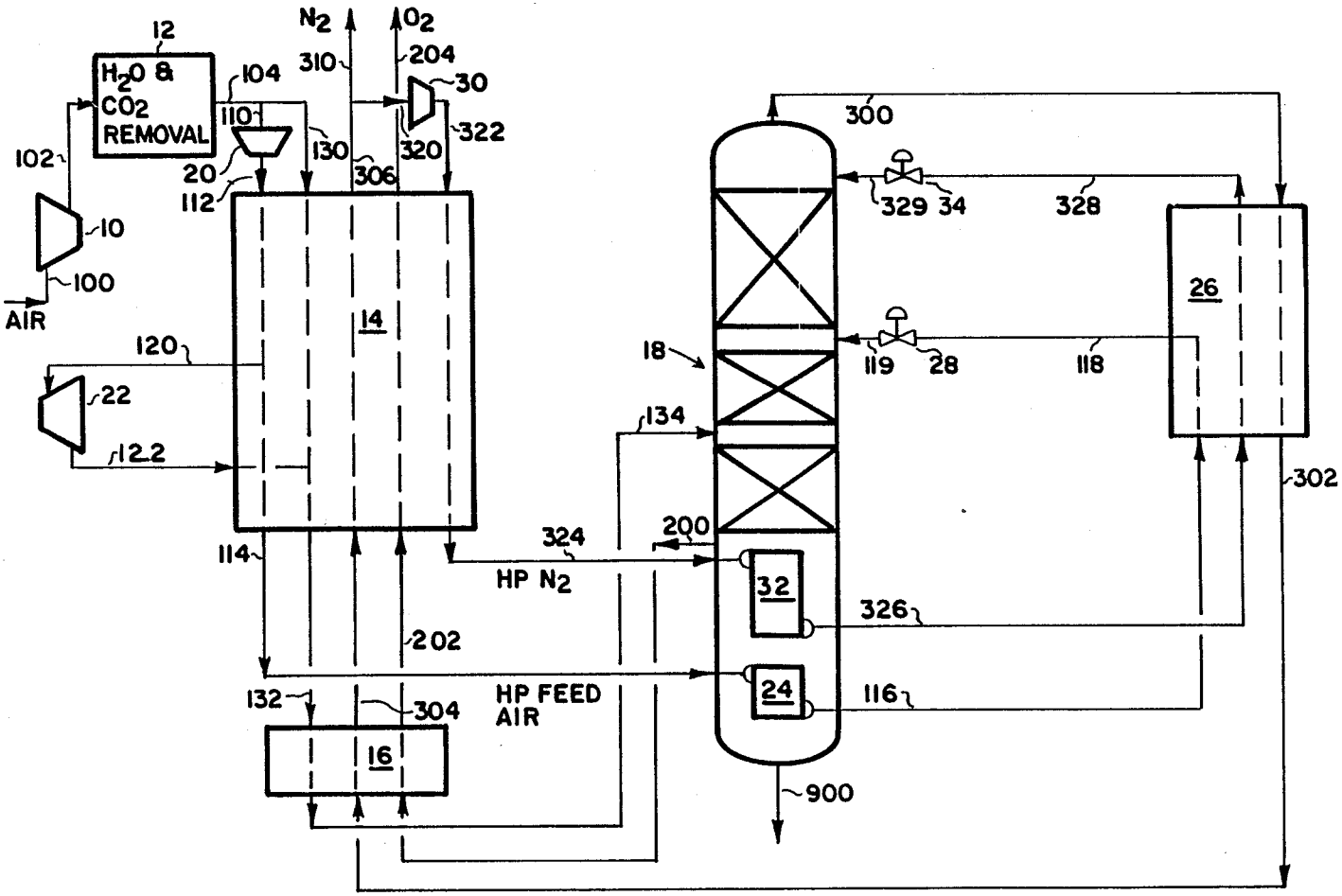
H2O & CO2 REMOVAL
AIR
HP N2
HP FEED AIR
O2
N2

CRYOGENIC PROCESS FOR PRODUCING LOW-PURITY OXYGEN

TECHNICAL FIELD

This invention relates to a cryogenic system for producing oxygen from air as well as a high-purity nitrogen product.

BACKGROUND OF THE INVENTION

In recent years there has been demand for high-pressure oxygen of medium purity, e.g. a purity from about 95–98% by volume for use in a variety of recovery processes. Two examples are the conversion of coal to gaseous or liquid products and the conversion of refuse to gaseous products. Large service cryogenic processes for the separation of air have also been associated with electric power generating facilities wherein a portion of the product gas stream is used as a source for large gas turbines.

The following patents disclose representative cryogenic systems for producing oxygen for the above applications:

U.S. Pat. No. 4,224,045 discloses one of the earlier cryogenic systems for the production of low-purity oxygen at relatively high pressure for use in power generation via a combustion turbine. The cryogenic process initially required compression of an air stream and an expansion of a part of that stream to provide refrigeration. The separation of the air was carried out in a double-column distillation system wherein the high pressure stage was operated at 100 to 250 psia and preferably 150 psia and the low pressure stage to be operated at a pressure of about 1/5 to ⅓ to that of the high pressure stage. By operating the double distillation column at higher pressures, the pressure of the waste nitrogen leaving the top of the double distillation column more nearly matched the optimum turbine inlet pressure for the combustion turbines.

In greater detail the process comprised compressing an air inlet stream and removing minor contaminants and cooling against exit process streams. A portion of the compressed feed stream is isentropically expanded and charged to the low pressure stage of the double distillation column for separation. The other portion of feed stream is charged to the high pressure column and separated into a nitrogen rich stream which is removed as an overhead and an oxygen rich stream as a bottoms. A portion of the nitrogen rich overhead is charged to a condenser/evaporator for reboiling liquid at bottom of the low pressure stage. A portion of the nitrogen condensate exiting the condenser/evaporator then is further cooled and isenthalpically expanded prior to introduction into the top of the low pressure stage as reflux. Oxygen rich condensate leaving the bottom of high pressure column is cooled and isenthalpically expanded and introduced as intermediate reflux in the low pressure stage. Nitrogen product is removed from the top of the high pressure stage and warmed against incoming feed streams. Low-purity oxygen is removed from the low pressure column and warmed against feed streams. Another nitrogen-rich product stream is also removed from the top of the low pressure column and warmed against feed streams.

U.S. Pat. No. 4,382,366 discloses an air separation process utilizing a single distillation column. as opposed to the double-column distillation system described in the '045 patent. In that process air is expanded and cooled against product streams and then split into two fractions. A first fraction is cooled and introduced into a condenser/evaporator at the bottom of the distillation column for effecting reboil. Then it is withdrawn, cooled, isenthalpically expanded and introduced to the top of the column for providing reflux. The second fraction of the feed air stream is cooled, work expanded, i.e.. expanded in a turbine and introduced into a middle section of the distillation column for rectification. A problem associated with the '366 process is that air is used as the reflux for the column and thus substantial amounts of oxygen are lost with the nitrogen product as it exits the column. As a result recovery of a higher purity nitrogen or higher percentage of oxygen from the air stream is generally difficult and requires higher power requirements.

U.S. Pat. No. 4,464,188 discloses an air separation process utilizing a single rectification column. In the air separation process, a feed gas, after compression and treatment to remove moisture and contaminants, is split into two streams wherein one portion is cooled and introduced to a middle section of the single rectification column for separation. The remaining portion of the air stream is compressed, cooled and then introduced into a condenser/ evaporator or reboiler at the bottom of the single rectification column for effecting reboil. The condensation product then is removed, further cooled, isenthalpically expanded and introduced to the column for separation. An oxygen enriched stream is removed from the bottom of the column, cooled. isenthalpically expanded and introduced to a sump of a condenser at the top of the column. A nitrogen enriched stream is removed from the top of the column and condensed against the oxygen in the sump of the condenser and introduced back into the column as reflux. The balance of the nitrogen stream is removed as product, warmed against process streams. A portion of that product stream is compressed, cooled and condensed in another condenser/evaporator located in a bottom section of the distillation column. The stream is then expanded and fed as a part of the reflux stream in the top section of the distillation column. Although the process was primarily designed to produce very pure nitrogen product stream, it could be used to provide high-purity oxygen. However, the oxygen product would be at relatively low pressure because of the expansion prior to introducing to the sump of the condenser and for power plant applications as contemplated herein would have to be compressed.

U.S. Pat. No. 4,655,809 discloses an air separation process for the recovery of pressurized, substantially pure oxygen gas utlizing a single pressure distillation column. Nitrogen product obtained from the process is used to provide power for feed air compression and segregated heat pump compression. The single distillation column utilized a segregated heat pump cycle where a compressed working fluid was cooled against product streams and condensed in an condenser-/evaporator at the bottom of the single stage column. The condensate then was isenthalpically expanded, reboiled and returned to the recycle compressor. A portion of nitrogen from the top of the column was condensed against the expanded working fluid and returned as reflux to the column.

U.S. Pat. No. 4,707,994 discloses an air separation process wherein an air stream is compressed, cooled and, expanded to provide refrigeration, for the process. The expanded feed is condensed in a condenser- /evaporator in the bottom of a single pressure distillation column for providing reboil. The condensate is cooled and then split into two streams wherein a first part is isenthalpically expanded and is introduced to the column for separation. The second portion is also isenthalpically expanded and then introduced to a condenser/evaporator at the top of the single stage distillation column to provide the condenser duty. The vaporized stream is then warmed against condensate from the condenser/evaporator and then split into two fractions wherein one is compressed at low temperature and reintroduced to the single pressure column and the remaining portion warmed against incoming streams and used as surplus gas.

SUMMARY OF THE INVENTION

This invention relates to an improved air separation process for the generation of low-purity, high pressure oxygen utilizing a single pressure distillation column. As with many of the previous single pressure distillation cycles, the basic process comprises compressing air to an elevated pressure and initially removing impurities that freeze at cryogenic temperatures. The feed stream then is cooled and split into two fractions wherein a first portion is cooled and introduced to a middle section of the single pressure distillation column for separation. The second high pressure portion is cooled and condensed in a condenser/evaporator near the bottom of the column and is used to effect reboil in the column. The liquid air from the condenser/evaporator is expanded and introduced to the column for separation. The improvement in this process comprises:

(a) further compressing the second fraction to an elevated pressure after the feed stream is split into two fractions thus forming a high pressure air stream;

(b) condensing the second fraction from step (a) in said condenser/ evaporator near the bottom of the column for effecting reboil;

(c) expanding the condensed second fraction and charging to a middle portion of the column for separation;

(d) recovering a nitrogen rich product from the top of the column;

(e) compressing and cooling a portion of the nitrogen rich product;

(f) cooling a portion of the compressed and cooled nitrogen rich stream in a second condenser/evaporator for effecting reboil in the column; and, (g) expanding the cooled nitrogen rich stream and introducing the expanded stream into the top of the column for providing high purity reflux.

Significant advantages result from the use of the high pressure air stream and high pressure nitrogen product stream to effect reboiling in the single pressure distillation column and these advantages include:

an ability to utilize a single pressure distillation column which thereby reduces associated costs inherent in double-column systems;

an ability to generate high pressure, low-purity oxygen with enhanced oxygen recovery from an incoming air stream;

an ability to produce a relatively high-purity, high pressure nitrogen stream which can be used for a multitude of uses. e.g,. as a gas source for a combustion turbine; and an ability to produce high pressure, low-purity oxygen with reduced power requirements.

THE DRAWING

The drawing is a flow diagram of an air separation process using a single pressure distillation column incorporating a dual working fluid reboiler system.

DETAILED DESCRIPTION OF THE INVENTION

To facilitate an understanding of the invention reference is made to FIG. 1. More particularly, air is introduced through line 100 to compressor 10 where it is pressurized to a pressure ranging from about 85–250 psia, assuming such air stream is below such pressure. The compressed air stream is removed through line 102 and introduced to contaminant removal unit 12 designed for the removal of water and carbon dioxide. Typically, these units comprise regenerative heat exchangers, gel traps, molecular sieves, alumina, external refrigeration or a combination of these various processes to effect removal of impurities which freeze at any cryogenic temperatures. From there the impurity-free air stream is removed via line 104 where it is split into two fractions as represented by lines 110 and 130. The first fraction, which is represented by line 130, is cooled in heat exchanger 14 and removed and conveyed via line 132 to heat exchanger 16 for further cooling followed by removal via line 134 in a cooled state. This high pressure, cooled air stream is introduced to the middle section of single pressure distillation column 18 for separation.

A second fraction of the impurity free air stream is removed via line 110 and compressed in compressor 20 to a pressure ranging from about 200 to 475 psia for the purpose of providing the additional required refrigeration for the cycle. The compressed stream is removed via line 112 where it is cooled to an initial temperature ranging from about 0 to 200° F. which may vary depending on process parameters. At that point a portion is removed via line 120 and isentropically expanded in expander 22 to feed pressure. The expanded stream is removed via line 122 and combined with stream 130 for further cooling and subsequent introduction to the single pressure distillation column 18. The remaining portion of stream 112 is cooled and removed from heat exchanger 14 via line 114 wherein it is then transferred to a first condenser/evaporator 24 located near the bottom of single pressure distillation column 18. The high pressure air stream which is at a pressure preferably below its critical pressure for enhancing heat transfer capability is passed through the condenser/evaporator usually at a rate from 0.1 to 0.4 moles per mole of feed air charged through line 134 and 119 to single pressure distillation column 18. The high pressure air is condensed thereby generating a portion of the reboil necessary for operation of the single pressure distillation column 18. The condensed high pressure feed air is removed from the condenser/evaporator or reboiler 24 through line 116 where it is further cooled in heat exchanger 26 and the cooled condensate removed via line 118. This high pressure stream then is isenthalpically expanded in Joule Thompson (JT) Valve 28 and then introduced to single pressure distillation column 18 as intermediate reflux via line 119.

Distillation in single pressure distillation column 18 is conventional in that the column is fitted with a plurality of trays, e.g., usually from about 40 to 80 trays to enhance the separation of the more volatile nitrogen component from the less volatile oxygen component. An overhead stream rich in nitrogen, e.g. 90 to 99% nitrogen by volume is removed from single pressure column 18 via line 300. A low purity, high pressure oxygen product stream is removed via line 200 near a lower section of the column wherein the concentration of oxygen ranges from about 85 to 99% by volume. A small proportion of heavy condensate is removed via line 900 from the bottom of the column usually as a purge stream. The high pressure oxygen product stream is withdrawn via line 200 from single pressure distillation column 18 and warmed against incoming feed streams in heat exchangers 16 and 14 respectively and then discharged at pressure from heat exchanger 14 through line 204.

The nitrogen product stream is removed from single pressure distillation column lB via line 300. This nitrogen stream is initially warmed against an incoming nitrogen condensate stream and an incoming air stream in heat exchanger 26. The partially warmed nitrogen stream is removed via line 302 to heat exchanger 16 wherein it is removed via line 304 for warming against additional process feed streams in heat exchangers 16 and 14. Then it is removed via line 306. One of the keys to obtaining high recovery of oxygen and for enhancing the power efficiency of the cycle is in the proper utilization of the nitrogen product stream. After warming the nitrogen stream to split and a portion of the nitrogen product stream from line 306 is removed as product via line 310, which is roughly at the same pressure as the feed air stream 102. The other portion of nitrogen product stream is removed from line 306 via line 320 where it is compressed from the exit stream pressure to about 250 to 475 psia in compressor 30. The compressed stream is removed from compressor 30 via line 322 and cooled against product streams in heat exchanger 14 and then removed via line 324. The cooled, high pressure nitrogen stream, which is preferably at a pressure below the critical pressure for heat transfer reasons, is introduced to a second condenser/evaporator 32 located in the bottom of single pressure distillation column lB. The addition of the cooled, high-pressure nitrogen into condenser/evaporator 32 provides the additional reboil necessary for column operation. The condensed nitrogen is removed from second condenser-/evaporator 32 via line 326 where it is further cooled in heat exchanger 26. The cooled condensed stream is removed via line 328 and then isenthalpically expanded in Joule Thompson Valve 34 and introduced into the top portion of single pressure distillation column 18 to provide high purity nitrogen as reflux via line 329. The addition of the high pressure nitrogen reflux enhances oxygen recovery.

The ratio of high pressure air flow rate in first condenser/evaporator 24 to the high pressure nitrogen flow rate in second condenser/evaporator 32 will be a function of the desired recovery rate of oxygen in the cycle. Higher recoveries of oxygen generally require lower ratios of high pressure air to high pressure nitrogen. Typically for an oxygen recovery of from 0.15 to 0.2 moles oxygen per mole of total feed air charged to the column, a ratio of from 0.1 to 0.7 moles high pressure air per mole of high pressure nitrogen charged, preferably 0.2–0.5 moles high pressure air per mole of high pressure nitrogen charged, is used.

The combination of using a compressed high-purity nitrogen to effect reboil in the single pressure distillation column and then as reflux enhances recovery of oxygen and reduces power requirements for the overall process cycle. In contrast, some of the prior art systems have used air to effect total reboil in the column. e.g., the '994 patent and the '366 patent. The advantage here of using the two working fluids at high pressure, i.e., the high pressure feed air stream and the high pressure nitrogen stream with the latter being used as a mechanism for effecting required reboil while providing the desired purity reflux when introduced into the top of the column minimizes the amount of air that must be compressed and routed to the reboiler at the bottom of the column. As a result power efficiencies are maximized. Further, the process eliminates the need for expanding high pressure oxygen to the sump condenser to obtain the reflux as noted in the '188 patent.

Several process variations can be made in the above-described process cycle to further enhance the power reductions of the process and to render the process flexible for serving a variety of applications. One example showing the adaptability of this process for power generation through a combustion turbine utilizing a portion of the compressed feed air stream from line 102. A fraction of the nitrogen product from stream 310 is combined with the air from line 102 as feed gas to the turbine. The resultant stream at high pressure then is charged to a combustion chamber for the generation of power. A portion of that same nitrogen product stream 310 may be diverted from the combustion chamber and used to quench the hot gases as they leave the combustion chamber. The combustion gases can be expanded in a turbine to generate electricity or drive compressors for the process. Any hot exhaust gases can be used to preheat the air stream to the combustion chamber. Thus, the proposed air separation cycle can be beneficially used with the integrated coal gasification combined cycle (IGCC) power generators. The high pressure oxygen will be used in the coal gasifiers and the high pressure nitrogen would be returned to the power generation system as described above.

Another process variation involves the production of high purity nitrogen. Although the process cycle is generally designed for the production of low purity, high pressure oxygen, a high-purity nitrogen product can be recovered from the top of single pressure distillation column 18 via line 300 by simple process expedients. One such expedient would be to remove a lower purity nitrogen product from the single pressure column 18 at a point intermediate the introduction of air via line 119 to single pressure column via line 329. This intermediate waste nitrogen stream then can be recovered as product leaving a higher purity nitrogen stream to be recovered via line 300. Thus, in this option, high purity nitrogen is compressed in compressor 30 and used as circulating fluid. An optional variation on this method would avoid the use of high purity nitrogen as the circulating fluid. This variation would require a split of the less pure nitrogen recycle as provided in line 328. One portion would be introduced directly to the column and the second portion would be isenthalpically expanded and charged to a boiler/evaporator located at the top of the column. Nitrogen vapor from the distillation column would be condensed by this boilder/condenser and would provide essentially pure reflux to the column. The vaporized less pure nitrogen from the boiler/evaporator could also be recycled.

Other variations are possible. For example, a feed at higher pressure than required for rectification may be well utilized in the present process in the sense of maximizing energy recovery. One such embodiment would dictate work expansion to desired pressure and using the energy in excess to that needed for refrigeration to cold compress nitrogen for reboiler use. Other variations may utilize isenthalpic expansions versus isentropic expansions as described or vice versa. When mole sieves are used for $CO_2$ and $H_2O$ removal from feed air, a stream at column pressure such as feed air or $N_2$ from the column could be expanded to much lower pressure to supply refrigeration requirement of this plant. The resulting lower pressure stream can be warmed and used for mole sieve regeneration.

The following examples are provided to illustrate various embodiment of the invention and are not intended to restrict the scope thereof.

EXAMPLE 1

A process described in reference to FIG. 1 was carried out for the purpose of generating a lower purity (97.3%), high pressure oxygen and high pressure nitrogen products at high oxygen recovery rates.

Table 1 below sets forth results for such process cycle to produce 97.3% oxygen at 109 psia. The oxygen recovery for this process was fixed at 0.1751 moles per mole of feed air. Streams are listed alone with various conditions throughout the cycle as well as the compositions based on the introduction of one mole air feed to the system.

TABLE 1

| Stream | Press. psig | Temp. °F. | Relative Molar Flow Rates | $O_2$ Concentration (Volume %) | $N_2$ Concentration (Volume %) |
|---|---|---|---|---|---|
| 100 | 14.7 | 85 | 1 | 20.95 | 78.12 |
| 102 | 113 | — | 1 | 20.95 | 78.12 |
| 112 | 253 | — | 0.371 | 20.95 | 78.12 |
| 114 | 252 | −231 | 0.3 | 20.95 | 78.12 |
| 116 | 252 | −252 | 0.3 | 20.95 | 78.12 |
| 118 | 252 | −267 | 0.3 | 20.95 | 78.12 |
| 119 | 107 | −277 | 0.3 | 20.95 | 78.12 |
| 120 | 253 | −32 | 0.071 | 20.95 | 78.12 |
| 122 | 113 | −113 | 0.071 | 20.95 | 78.12 |
| 134 | 108 | −251 | 0.7 | 20.95 | 78.12 |
| 200 | 110 | −253 | 0.18 | 97.3 | 0.00 |
| 300 | 106 | −280 | 1.509 | 4.08 | 95.4 |
| 302 | 106 | −254 | 1.509 | 4.08 | 95.4 |
| 310 | 105 | 40 | 0.819 | 4.08 | 95.4 |
| 322 | 290 | 45 | 0.69 | 4.08 | 95.4 |
| 326 | 289 | −251 | 0.69 | 4.08 | 95.4 |
| 329 | 106 | −280 | 0.69 | 4.08 | 95.4 |
| 900 | 110 | −253 | 0.001 | 97.9 | 0.00 |

EXAMPLE 2

VARIABLE RECOVERY RATES OF OXYGEN

The procedure as described using the process flowsheet as described in Example 1 was repeated except that the moles of oxygen per mole of air recovered from the single pressure distillation column, as exemplified by line 200, was varied from 0.1654 to 0.1946. The moles of air introduced as high pressure reboil fluid in condenser/evaporator 24 per mole of feed air was maintained at 0.2. The moles of recycle nitrogen per mole of air feed to the cold box was varied in order to provide for the enhanced recovery of oxygen from the distillation column and ranged from 0.73 to 0.92. Power calculations were made and the calculations were based on kilowatt hours per pound mole of oxygen product. It is assumed that the product nitrogen stream was used for power generation and therefore in the calculation for energy consumed to produce one mole of oxygen product stream, credit for the pressure energy in product nitrogen stream was taken into account. Table 2 below sets forth these results.

TABLE 2

Power Consumption for Various $O_2$ Recoveries: Example 1

| | Ex. 1 | A | B | C |
|---|---|---|---|---|
| Moles $O_2$/Mole air recovered via line 200 | 0.1654 | 0.1751 | 0.1849 | 0.1946 |
| Moles of air to condenser/evaporator 24 per mole of feed air | 0.2 | 0.2 | 0.2 | 0.2 |
| Moles of nitrogen to condenser/evaporator 32 per mole of feed air | 0.73 | 0.79 | 0.86 | 0.92 |
| Power required, kwh/lb mole of $O_2$ product | 4.13 | 4.13 | 4.14 | 4.14 |

From Table 2, it is seen that fairly high recoveries of $O_2$ can be achieved from the single pressure distillation column 18 with the power consumption per unit of the $O_2$ product stream being fairly constant. Moreover, the $O_2$ stream. This is particularly beneficial in situations where a very high flow rate of the $N_2$-rich waste stream, in line 310, may not be desirable.

Comparisons were made to Example 1 with respect to relative compressor power requirements and total power requirements for the process cycle as described in U.S. Pat. No. 4,244,045. Once power power credit for the coproduction of high pressure nitrogen was taken into account. The results are set forth in Table 3.

TABLE 3

| | U.S. Pat. No. 4,224,045 | Ex. 1 |
|---|---|---|
| Relative compressor power | 1.03 | 1.00 |
| Relative total power | 1.01 | 1.00 |

In the above Table 3, the relative powers used by the compressors for both processes are listed. It is seen that the process being presented requires less compressor power than of the prior art. Even when the other power requirements, such as that required by the mole sieves and precoolers, are added to the power required by the compressors, the total relative power is still the lowest. The process shown in FIG. 1 consumes more power in the precooler and mole sieves, because the pressure of the air feed to the cold box is about one-third to one-fourth of the other process. As a result, its water content is much higher and more energy must be expended to remove this water.

The power required by the new cycle, however, can be further reduced by using two mole sieve units in FIG. 1. Rather than feeding all the compressed air stream, 102, to a single mole sieve unit, it can first be split into two streams; one stream can be treated in a mole sieve unit to provide stream 130, while the second one would be further compressed and then treated in the second mole sieve unit to give stream 112. Since the flow rate of stream 112 is about 30% of the total air feed, the power savings would be substantial. Furthermore, in this example, $O_2$ was produced at about 109 psia; but at higher product pressures when the distillation is run at elevated pressures, the precooler-mole sieve power for the present invention would be reduced much more as compared to that of U.S. Pat. No. 4,224,045. Of course, one of the biggest benefits of the present invention over the process of U.S. Pat. No. 4,244,045 is that instead of a double distillation column, it uses a signal distillation column, which will reduce the distillation column capital cost.

What is claimed is:

1. An improved air separation process for the generation of a low-purity, high pressure oxygen stream and a high pressure nitrogen rich stream utilizing a single pressure distillation column which comprises compressing air to an elevated pressure to form a compressed air stream, removing impurities that freeze at cryogenic temperatures; splitting the compressed air stream into two fractions, the first fraction being further cooled and introduced to the single pressure distillation column for separation and the second fraction compressed and used to effect reboil in the single pressure distillation column by passage through a condenser/evaporator, whereby a low purity, high pressure gaseous oxygen stream is recovered as a bottom fraction and a high pressure nitrogen rich product recovered as an overhead fraction, the improvement which comprises:

(a) further compressing the second fraction after the compressed air stream is split into two fractions to an elevated pressures and thus forming a high pressure second fraction;

(b) condensing the high pressure second fraction in said condenser/evaporator near the bottom of the single pressure distillation column for effecting reboil;

(c) expanding the resulting high pressure condensed second fraction and charging to a middle portion of the single pressure distillation column for separation;

(d) recovering a nitrogen rich product from the top of the single pressure distillation column;

(e) compressing and cooling a portion of the nitrogen rich product to form a compressed and cooled nitrogen rich product;

(f) condensing said portion of the compressed and cooled nitrogen rich product is a second condenser/evaporator for effecting reboil in the column to form a condensed nitrogen stream;

(g) expanding the condensed nitrogen stream; and, (h) introducing the expanded nitrogen rich product stream into the top of the single pressure distillation column for providing high purity reflux.

2. The process of claim 1 wherein a portion of the high pressure second fraction which was been further compressed to an elevated pressure is expanded and combined with said first fraction for separation in said single pressure distillation column.

3. The process of claim 2 wherein said second fraction after effecting reboil is further cooled, isentropically expanded and then introduced into the single pressure distillation column as intermediate reflux.

4. The process of claim 2 wherein said second fraction, after effecting partial reboil in said single pressure distillation column, is further cooled, isenthalpically expanded and then introduced into the single pressure distillation column as intermediate for separation.

5. The process of claim 3 wherein said second fraction is isentropically expanded and combined with said first fraction.

6. The process of claim 3 wherein said condensed nitrogen stream after removal from the second condenser/evaporator is isenthalpically expanded prior to introduction into the top of said single pressure distillation column as reflux.

7. The process of claim 6 wherein the ratio of the second fraction to effect reboil to total air charged to said single pressure distillation column ranges from 0.1 to 0.4 moles.

8. The process of claim 7 wherein the mole ratio of high pressure second fraction per mole of compressed and cooled nitrogen rich product for effecting reboil at the bottom of the single pressure distillation column ranges from about 0.1 to 0.7.

9. The process of claim 8 wherein mole ratio of second fraction to compressed and cooled nitrogen rich product charged to said single pressure distillation column ranges from about 0.2 to 0.5.

10. The process of claim 9 wherein air is initially compressed to a pressure of from about 85 to 250 psia.

11. The process of claim 10 wherein the pressure of the compressed and cooled nitrogen rich product charged to the condenser/evaporator ranges from 250 to 475 psia.

12. The process of claim 11 wherein the second fraction is compressed to a pressure from about 200–475 psia.

* * * * *